United States Patent [19]

Wimberly

[11] 4,327,841

[45] May 4, 1982

[54] INSULATED OUTLET COVER

[76] Inventor: Joseph Wimberly, 637 Belden, Elmhurst, Ill. 60126

[21] Appl. No.: 198,521

[22] Filed: Oct. 17, 1980

[51] Int. Cl.[3] ..... B65D 25/24

[52] U.S. Cl. ..... 220/18; 220/3.4; 220/3.8; 174/66

[58] Field of Search ..... 220/3.2, 3.4, 3.8, 18; 174/66

[56] References Cited

U.S. PATENT DOCUMENTS 1,952,719 3/1934 Lewin ..... 220/241 X 2,167,419 7/1939 Heanes ..... 220/3.8

*Primary Examiner*—George T. Hall

*Attorney, Agent, or Firm*—Fitch, Even, Tabin, Flannery & Welsh

[57] ABSTRACT

This invention teaches an improved cover designed to be positioned in place over an electric outlet box otherwise exposed on the outside of an exterior wall operable to weatherize the wall and minimize leakage past the outlet box. The cover has a tubular wall, and a flange and closure wall are integral with the tubular wall and disposed at its opposite ends respectively transversely thereto. The cover is formed of plastic and is unitary, with the tubular wall being continuous circumferentially, with the flange extending radially outward from the tubular wall and being continuous peripherally, and with the closure wall having an opening therein which corresponds in size to the access opening on the outlet box. The cover flange is positioned flush against the exterior wall with the closure wall opening lined up adjacent the outlet box, and the flange is secured by nails or the like to the exterior wall in this position. As such, the outlet box is completely enclosed by the cover and yet it is accessible through the closure wall opening. The closure wall preferably butts against the outer face of the outlet box to become structurally reenforced thereagainst and provide thereby for the flush mounting of an electrical fixture or the like against the closure wall and tightly against the underlying outlet box. The cover, being formed of plastic and having the continuous tubular wall and flange arrangement also provides electrical insulation around the outlet box. The exterior face of the closure wall can be woodgrained and the cover can be color blended with the exterior wall for improved appearance.

10 Claims, 3 Drawing Figures

INSULATED OUTLET COVER

BACKGROUND OF THE INVENTION

Electric outlet boxes accessible from the exterior of a building wall are commonly weatherized to minimize moisture or air leakage into the wall itself. The outlet box is typically mounted within an opening in the wall with a clearance gap around the box and opening. Even if that gap is packed with caulk or the like in time it becomes ineffective and frequently is a source of leakage.

It is also common to encounter exterior wall structure having an under layer of wallboard or the like and siding of aluminum or wood over the wallboard for improved appearance and durability. A flanged cover that fits over the outlet box is then frequently mounted flush against the wallboard, and the siding then overlaps the cover flange. This provides a mechanical type seal over the wall opening and it also directs water runoff on the siding past the cover and the wall opening.

Existing covers generally are formed of metal bent from flat metal stock, and thus commonly have open or broken corners. In other words the cover peripherally around the flange and around the tubular wall structure itself is not continuous, so that it might not be weathertight. Moreover, metal covers are electrically conductive, so that an electrical short in the outlet box or in any of the wiring connected in the box can be transmitted through the cover to the wall itself or a person touching the cover. This not only can be power consuming but it also can be highly dangerous. Further, the metal covers can be easily scratched or dented to become unsightly in appearance. There is the further possibility that the cover might clash with or at least not match the wall siding in color or texture, or the light fixture secured in place over the outlet box.

SUMMARY OF THE INVENTION

This invention provides an improved cover designed to be mounted against an exterior wall to overlie and enclose an otherwise exposed electric outlet box. The cover is formed of plastic as a unitary component and thereby is an electrical insulator. The cover has a continuous tubular wall and a continuous flange formed at one end of the wall structure and a closure panel formed at the opposite end of the tubular wall. The cover is mounted with the flange against the wall in a weathertight fashion to minimize leakage into the wall structure. An opening in the closure panel is lined up with the underlying outlet box to provide access to the box. A typical flanged electrical fixture can be secured against the front closure plate. Inasmuch as the tubular wall and flange are continuous, leakage is precluded at the corners, and a sound dielectric barrier is established across the cover for electrical insulation of the box. The cover further can be woodgrained for improved appearance, and can be color shaded to blend in with the wall siding or exterior wall.

DETAILED DESCRIPTION OF THE INVENTION

Figure 1:
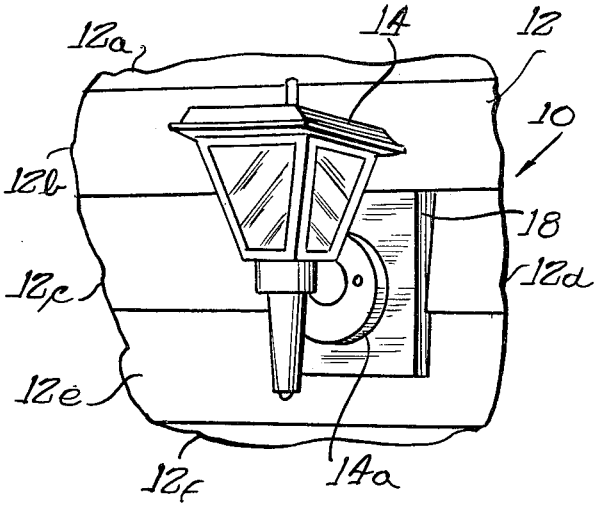
FIG. 1 is a perspective view of an exterior building wall showing a decorative light fixture mounted in place over the inventive cover component and secured to the wall.
Figure 2:
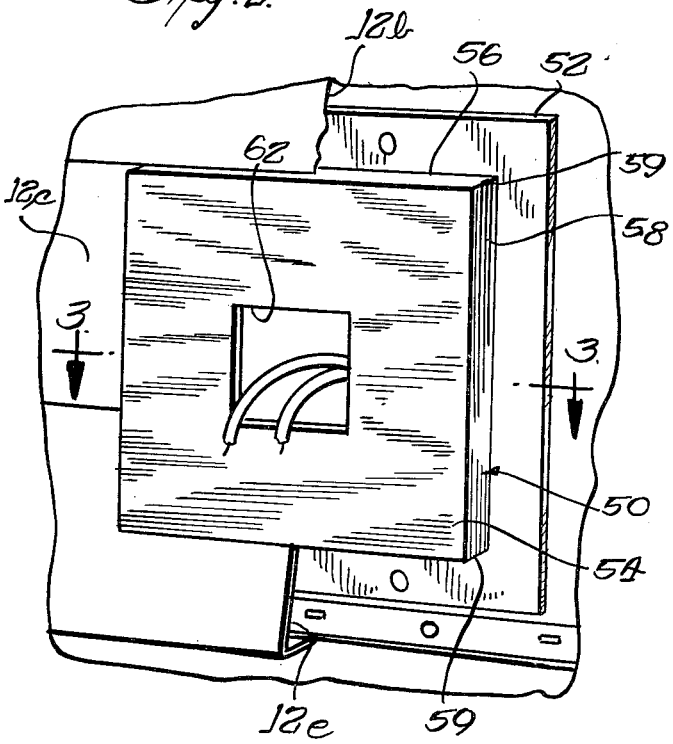
FIG. 2 is an enlarged perspective view of the assembly shown in FIG. 1, except with the light fixture removed and with part of the exterior siding broken away, each for clarity of disclosure.

FIG. 1 illustrates a building wall 10 having exterior siding 12 and an electric light fixture 14 mounted on the wall 10 over the improved cover component 16. The cover component 16 overlies and hides an electric outlet box 18, (FIG. 3), in part underlies the adjacent siding 12, and underlies also the mounting flange 14*a* on the lighting fixture 14.

Figure 3:
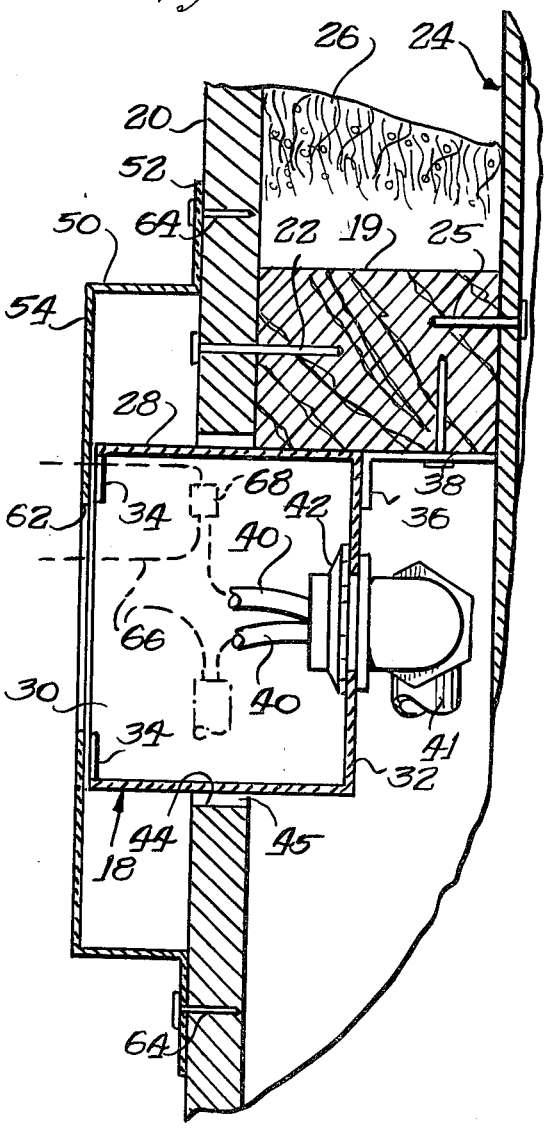
FIG. 3 is a sectional view as seen generally from line 3—3 in FIG. 2.

As is illustrated in FIG. 3, the wall 10 includes "two by four" studs or other structural elements (only one at 19 being shown) which run vertically and which are spaced apart horizontally. Exterior wall board 20 is secured, as by nails (only one at 22 being shown), to the outside of the spaced studs 19; interior wall panel 24 is secured, as by nails (only one at 25 being shown), to the inside of the studs 19; and insulation 26 is located between the studs 19 and the exterior wall board 20 and interior wall panel 24.

The outlet box 18 generally is comprised of opposed pairs of parallel walls 28 and 30 and a rear wall 32 forming a rigid structure with one end open. Flanges 34 inturned from the forward edges of the walls 28 and 30 and having threaded taps to receive screws 35 provide for the ready securement of an electric outlet and/or a cover plate (neither being shown) or the fixture flange 14*a*. The box 18 itself is secured by a bracket 36 and nail 38 to the stud 19 in a manner so that the exterior flanges 34 are generally parallel to the wall board 20. Power is brought to the outlet box 18 via conductors 40 housed in a conduit or cable 41 secured by an elbow connector 42 to the box.

In this mounted position, the outlet box 18 fits within a larger opening 44 in the wall board 20 so that leakage of both air and water is quite possible through a gap 45 around the box and into the interior of the wall 10. It is possible of course to use various barriers such as seals or caulking in an attempt to close the gap 45, but such generally deteriorate and becomes less effective after time. The outlet box 18 can be for exterior use where seals (not shown) can be used on the cover plate (not shown) to make the box weathertight.

The siding 12 is generally comprised of separate elongated sheets or boards 12*a–f*, as illustrated, which extend horizontally and are lapped over one another with the lower edge of each board overlapping the upper edge of the board immediately below it. This provides that water on the exterior face of the siding 12 basically runs down the wall and does not pass the innerfitting sheets into the wall.

To minimize water and air leakage into the wall past the outlet box, it has been somewhat common to position a cover over the outlet box 18 and against the wall board and under the siding sheets so as to enclose the outlet box. One form of cover was fabricated from a flat sheet metal bent across edges to define a flanged box-like structure, but gaps across the corners allowed leakage into the interior of the box-like cover structure. Further, the metallic cover structure was electrically conductive so that should an electrical malfunction occur in the outlet box, the cover structure could be electrified and be potentially dangerous to the touch.

Moreover, the metal cover structure could be easily dented to become unsightly.

These deficiencies have been overcome with the improved outlet cover component 18 disclosed herein. The cover component 18 is formed as a single piece of plastic so that it is continuous across all corners to act as a barrier against water leakage and electrical shorts. The cover is designed to fit with a flange flush against the wall board 20 and under the siding, and with an exterior closure face overlying and covering the outlet box 18. This not only encloses the outlet box and presents an attractive appearance, but it also provides a flat exterior face against which the flange of the fixture can be secured. This establishes sound mechanical joints between the wall and cover and between the lighting fixture and cover for precluding leakage to the interior of the cover and past the gap 45 and into the wall. The exterior face of the cover moreover can be provided with woodrgrain impressions for added beauty.

Referring specifically to the drawing, it can be noted that the cover 16 has a tubular wall 50, and a flange 52 and a closure wall 54 are formed integrally with the tubular wall 50 at its opposite ends respectively and each is disposed transversely to the tubular wall. The tubular wall 50 is continuous circumferentially, formed of two pairs of opposed wall sections 56 and 58 respectively interconnected at generally right handed corners 59. Moreover, the flange 52 is extended radially outward from the tubular wall 50 and is peripherally continuous about the tubular wall. In a preferred embodiment the flange 52 may project between one and two inches away from the tubular wall 50. The closure wall 54 has an opening 62 formed therein which is designed to line up generally with the open front or access opening of the underlying outlet box 16.

In use, the cover flange 52 is butted against the exterior face of the wall board 20 and nails 64 or the like can be used for securing the flange directly against the wall board. In this secured position the opening 62 on the closure panel is designed to line up with and be disposed adjacent the access opening to the outlet box 16. As secured in place, the cover component 16 encloses and virtually hides the outlet box 16.

In the preferred use of this invention, the siding sheets 12*b–e* overlap the flange 52 and butt or almost butt against the tubular wall 50. This thereby allows for a mechanical arrangement for directing water along the exterior face of the siding past and over the exterior of the cover component 16 to minimize water migration to behind the flange. Also, since the cover flange 52 is flush against the wall board, this juncture can be adequately sealed by caulking and/or compression fit against the wallboard to minimize leakage to the interior of the cover component.

The particular interior dimension across the hollow within the tubular wall 50 from the one wall section 56 to the opposite wall section 58 is of the order of 4 to 7 inches for example. This allows for the cover component 16 to be positioned over most conventionally sized electric outlet boxes 18 while yet providing clearance radially of the box to the tubular wall 50. The opening 62 in the closure face 54 is preferably rectangular in shape and is sized to correspond to the access opening generally provided in the underlying outlet box 18. In a preferred manner of use, the electric outlet box 18 is mounted so that its flanged face at 34 is in near butting relationship to the front closure face 54 of the cover component 16. The light fixture flange 14*a* can then be mounted directly flush against the closure face 54 which in turn is strengthened by direct contact with the underlying outlet box. Of course, the lighting fixture 14 is secured to the outlet box 16 only after the leads (66 in phantom in FIG. 3) from the fixture are electrically connected by screw caps (68 in phantom in FIG. 3) or the like to the conductors 40 in the outlet box 18.

It is further possible to emboss the exterior face of the cover during its initial injection molding fabrication with woodgrained impressions. This thereby blends the cover in with the woodgrained character of the siding. It is further possible by tinting the plastic before it is molded as the outlet cover 16 to precolor the cover, to allow it to be matched with the siding color and/or the lighting fixture. For example, black might be a primary color since many typical light fixtures 14 as illustrated are colored in a gloss black enamel; but other colors of course would be possible.

The plastic cover 16 again has particular utility in that it forms an insulator enclosing the electric outlet box 18 to protect against shock that might be occassioned because of loose or defective wiring within the outlet box. The plastic cover also is durable and does not scratch, dent or rust, and is maintenance free in use. As noted the color selection can match the color of siding used, and further the woodgrain exterior can blend in with the typical woodgrain texture of the siding. Of utmost importance further is that the cover weatherizes the wall structure against air and/or water leakage as might be possible past the gap around the outlet box and into the wall.

While a light fixture 14 has been illustrated as secured against the outlet cover component 16, it would be possible to locate an electrical outlet connector (not shown) in the outlet box 18. Such an outlet connector would thus be secured mechanically in the outlet box by the screws 35 through the box flanges 34, and a closure plate would span and close the open front of the outlet box, again being held in place by the screws 35 through the box flanges. With proper seals between the closure plate and the outlet back and/or cover face 54 this butted connection would preclude leakage into the interior space within the cover. The connector outlets (not shown) themselves could be covered with a hinged plate (not shown) to maintain them clean in nonuse.

While it is intended that the disclosed cover 16 be used specifically in connection with a sided exterior wall, it is obvious that the cover can be used to cover an electric outlet box located in a wall that is not sided. Again, the cover would provide a durable watertight closure arrangement to minimize leakage into the wall structure and to minimize electrical shorts, any of which might be damaging and/or energy inefficient.

What is claimed is:

1. A cover for covering an outlet box mounted on an exterior building wall and for affording access thereto, said cover being formed of a single piece of plastic and having a flat outer wall and opening in said flat outer wall to provide access to the outlet box, a surrounding wall integrally joined to the periphery of said flat outer wall and extending substantially normal thereto, and an integrally joined attaching flange connected to the inner end of said surrounding wall for being placed against the building wall and being fastened thereto, said attaching flange being a continuous flange about the entire periphery of said cover.

2. A cover in accordance with claim 1 in which said flat outer wall is parallel to said attaching flange and said surrounding wall is perpendicular to said flat outer wall and said attaching flange.

3. A cover in accordance with claim 2 in which said surrounding wall has four corners and in which said cover is generally box-shaped.

4. In combination with an exterior building wall having an electrical outlet box mounted thereon for exterior access, a unitary cover having a tubular wall, and a flange and closure wall integral with the tubular wall at its opposite ends respectively and each disposed transverse thereto; said tubular wall being continuous circumferentially, said flange extending radially outward from the tubular wall and being peripherally continuous and said closure wall having an opening therein; said cover component flange being positioned against the exterior wall with the closure wall opening generally lined up with and disposed adjacent the outlet box, and means securing the flange to the exterior wall in said position; whereby the cover component encloses and visually hides the outlet box and weatherizes the exterior wall against leakage proximate the outlet box, while said outlet box is accessible through the opening in the closure wall.

5. A combination according to claim 4, wherein siding is applied to the outside face of the exterior wall and overlaps the exterior side of the flange and generally butts against the tubular wall.

6. A combination according to claim 4 wherein the unitary cover component is injection molded of plastic and thereby has a high dielectric constant.

7. A combination according to claim 4 wherein the surface of the closure wall facing in the direction away from the flange has wood grain impressions therein.

8. A combination according to claim 4 wherein the tubular wall in cross section paralleling the flange has four sides comprised of two pairs of opposed generally parallel wall sections respectively interconnected at generally right angle corner sections.

9. A combination according to claim 4 wherein said closure wall abuts against the outer edge of the electrical outlet box and thereby becomes structurally reenforced.

10. A combination according to claim 4 wherein said opening in the closure wall is rectangular in shape corresponding generally to the shape of the access opening of the electrical outlet box.

* * * * *